US005273343A

United States Patent [19]

Ojanen

[11] Patent Number: 5,273,343

[45] Date of Patent: Dec. 28, 1993

[54] NON-ROTATABLE SLEEVE FOR A CUTTING TOOL BIT HOLDER AND METHOD OF MAKING THE SAME

[75] Inventor: Randall W. Ojanen, Bristol, Tenn.

[73] Assignee: Valenite Inc., Troy, Mich.

[21] Appl. No.: 976,603

[22] Filed: Nov. 16, 1992

[51] Int. Cl.[5] ..... E21C 35/18

[52] U.S. Cl. ..... 299/10; 299/86; 299/92

[58] Field of Search ..... 299/10, 79, 86, 92; 76/115

[56] References Cited

U.S. PATENT DOCUMENTS

| | | | |
|---|---|---|---|
| 3,749,449 | 7/1973 | Krekeler | 299/93 |
| 4,084,856 | 4/1978 | Emmerich et al. | 299/86 |
| 4,201,421 | 5/1980 | Den Besten | 299/86 |
| 4,247,150 | 1/1981 | Wrulich et al. | 299/86 |
| 4,728,153 | 3/1988 | Ojanen | 299/92 |
| 4,836,614 | 6/1989 | Ojanen | 299/86 |
| 5,088,797 | 2/1992 | O'Neill | 299/91 |
| 5,098,167 | 3/1992 | Latham | 299/86 |

FOREIGN PATENT DOCUMENTS

| | | | |
|---|---|---|---|
| 295232 | 12/1988 | European Pat. Off. | 299/92 |

*Primary Examiner*—David J. Bagnell
*Attorney, Agent, or Firm*—Bill C. Panagos

[57] ABSTRACT

A deformed sleeve for mounting a cutting tool in a bit holder has one end shaped as an ellipse. The deformation is done by the application of pressure before heat treating. No further machining is necessary after the heat treatment. The deformed sleeve is force-fitted into a bore in a bit holder and is retained therein in a non-rotating manner by friction.

4 Claims, 1 Drawing Sheet

NON-ROTATABLE SLEEVE FOR A CUTTING TOOL BIT HOLDER AND METHOD OF MAKING THE SAME

TECHNICAL FIELD

This invention relates to bit holders for cutting tools and more particularly to a non-rotatable sleeve for use with such bit holders.

BACKGROUND ART

In the mounting of cutting tools via bit holders, which bit holders may be mounted on drums for rotation (see, for example, U.S. Pat. No. 3,749,449) it is occasionally desirable to mount the cutting bit through the intermediary of a sleeve, which can be a different material from the bit holder and more able to sustain the cutting environment without damage. Further, depending upon the application, it may be desirable to mount the sleeve so that it is rotatable about its longitudinal axis or to so mount it that it is non-rotatable. In the case of non-rotatable mounting it is generally appropriate to employ a sleeve which is friction-fitted into an appropriate aperture in the bit holder. When the sleeve is too tightly fitted, replacement in the field (which may be in a mine) becomes difficult. The prior art has addressed this problem in several ways. In U.S. Pat. No. 4,836,614 a device is described which protects the entire bit holder bore; however, it is not cost effective to manufacture since a separate sleeve must be attached to each tool. In U.S. Pat. No. 4,201,421 a split sleeve of spring steel or like material is employed; however, this sleeve must be inserted with the cutting bit and, likewise, removal of the cutting bit requires removal of the sleeve, whether it needs replacement or not. U.S. Pat. No. 5,088,797 provides a friction-fitted sleeve which has limited engagement with the internal surface of the bit holder bore to aid in removal. This sleeve requires considerable machining, both before and after heat treatment, to provide the 0.002" to 0.005" tolerances required to make it work well. This is an expensive consideration. U.S. Pat. No. 5,098,167 suggests the use of threaded sleeves to avoid rotation; however, this also adds to the cost and time of replacement. U.S. Pat. No. 4,247,150 provides for the use of an oil channel between the sleeve and the inner surface of the bit holder bore, with means for injecting oil under pressure to aid in removal. This solution also requires extra machining and added cost.

DISCLOSURE OF THE INVENTION

It is, therefore, an object of this invention to obviate the disadvantages of the prior art.

It is another object of the invention to enhance friction-fitted sleeves for cutting bit holders.

These objects are accomplished, in one aspect of the invention, by the provision of a sleeve for mounting a cutting tool in a bit holder, said sleeve comprising: a hollow, longitudinally extending body having a first end and a second end, said first end being substantially cylindrical in cross-section with a given diameter and said second end being substantially elliptical in cross-section and having its long axis greater than said given diameter.

It will be seen that the use of the invention described herein provides tremendous improvement over those devices of the prior art. It is limited to a small area of frictional contact; it does not have to be inserted and removed with the cutting bit, thus allowing for economical, selective replacement; it does not require additional threading operations; and it eliminates additional machining steps after heat treating.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
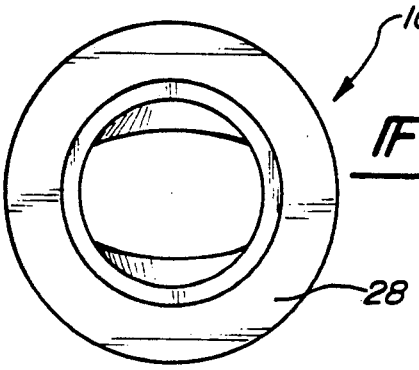
FIG. 1 is a top plan view of an embodiment of the invention.
Figure 2:
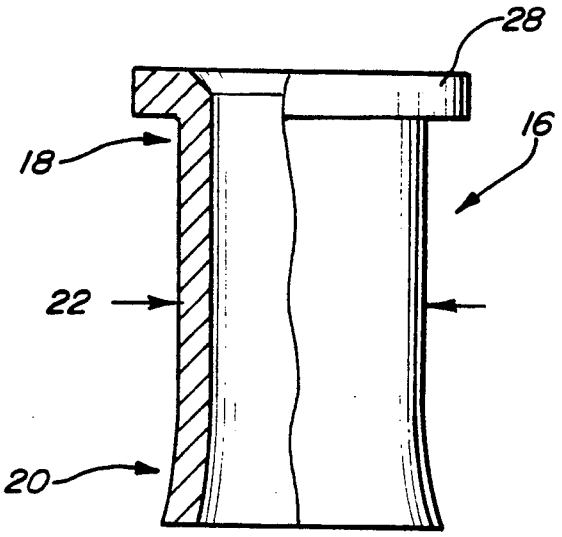
FIG. 2 is an elevational view, partially in section.
Figure 3:
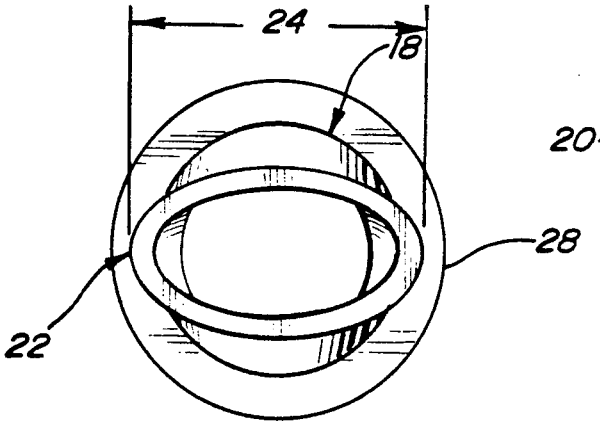
FIG. 3 is a bottom plan view.
Figure 4:
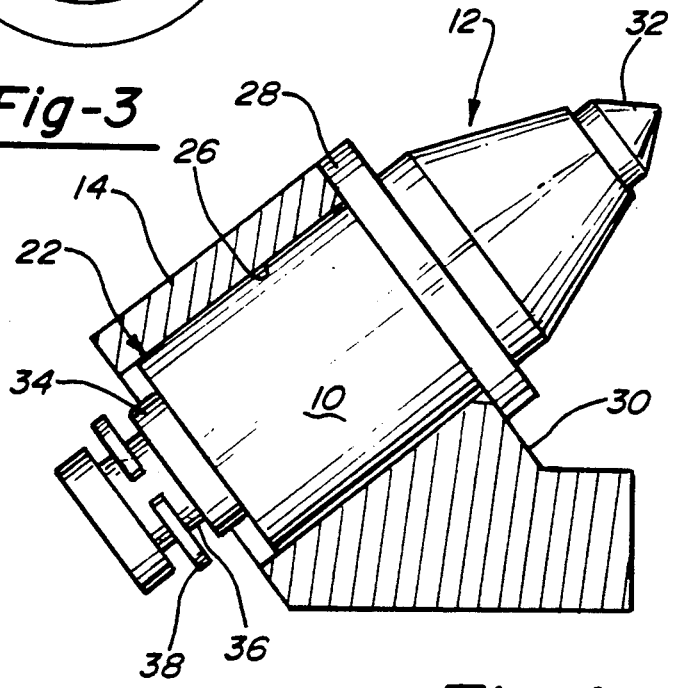
FIG. 4 is an elevational view, partially in section, of an assembled bit holder, sleeve and cutting tool.

Referring now to the drawings with greater particularity, there is shown in FIG. 4 a sleeve 10 for mounting a cutting tool 12 in a bit holder 14. The sleeve 12 (more clearly seen in FIGS. 1–3) comprises a hollow, longitudinally extending body 16 having a first end 18 and a second end 20. The first end 18 is substantially cylindrical in cross-section with a given diameter 22 and the second end 20 is substantially elliptical in cross-section and has its long axis 24 greater than the given diameter 22. The difference between diameter 22 and long axis 24 is exaggerated in the drawings for clarity. In practice, a difference of between about 0.002" and 0.005" is sufficient to retain the sleeve 10 in the bit holder 14.

To adjust the penetration of sleeve 10 into the bore 26 of bit holder 14, the sleeve can be provided with a collar 28 adjacent first end 18. The collar will contact a face 30 of the bit holder.

The cutting bit 12 has a cutting element 32 at one end thereof mounted upon a substantially cylindrical shank 34. The terminal end of shank 34 is provided with a groove 36 for receiving a retaining ring 38, which can be a "C" ring.

Thus, it will be seen that employment of this invention greatly reduces the cost of non-rotatable sleeves since no further machining is required after heat treating.

The sleeve can be manufactured by the usual techniques, for example, machining from a piece of suitable steel, and then lapplying sufficient pressure to the second end 22 to deform the same into a substantially elliptical configuration. As noted above, the degree of eccentricity need not by extreme, but a difference of 0.002" to 0.005" will be sufficient. Thereafter, the sleeve can be heat treated as usual. To insert the sleeve into a bit holder a hammer can be used. If necessary, the upper edge of bore 26, i.e., that edge closest to face 30, may be slightly enlarged to accept the widened second end 22, in order to start it more easily.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A sleeve for mounting a cutting tool in a bit holder, said sleeve comprising: a hollow, longitudinally extending body having a first end and a second end, said first end being substantially cylindrical in cross-section with a given diameter and said second end being substantially elliptical in cross-section and having its long axis greater than said given diameter.

2. The sleeve of claim 1 wherein said first end includes a collar having a diameter larger than said given diameter.

3. In a method of making a sleeve for mounting a cutting tool in a bit holder, said sleeve being formed from a deformable material and comprising a hollow, longitudinally extending body having a first end and a second end, said body being substantially cylindrical with a given diameter, the steps comprising: applying sufficient pressure to said second end to form said second end into an elliptical cross-section whose long axis is greater than said given diameter; and heat treating said sleeve.

4. A method of non-rotatively mounting a cutting tool holding sleeve in a bit holder, comprising: forming a sleeve from a deformable material and comprising a hollow, longitudinally extending body having a first end and a second end, said body being substantially cylindrical with a given diameter, applying sufficient pressure to said second end into an elliptical cross-section whose long axis is greater than said given diameter, heat treating said sleeve, providing a bit holder having a cylindrical bore formed to receive said sleeve, said bore having a diameter substantially equal to said given diameter; and forcing said sleeve into said bore whereby the elastic forces generated by said elliptical second end in said cylindrical bore fictionally maintain said sleeve therein.

* * * * *